US007318485B2

(12) United States Patent
Greese et al.

(10) Patent No.: US 7,318,485 B2
(45) Date of Patent: Jan. 15, 2008

(54) METHOD OF CONTROLLING THE DIRECTION OF ROTATION OF A POWER TOOL

(75) Inventors: Oliver Greese, Filderstadt (DE); Thomas Scholl, Reutlingen (DE)

(73) Assignee: C. & E. Fein GmbH (DE)

( * ) Notice: Subject to any disclaimer, the term of this patent is extended or adjusted under 35 U.S.C. 154(b) by 51 days.

(21) Appl. No.: 11/304,880

(22) Filed: Dec. 15, 2005

(65) Prior Publication Data

US 2006/0157260 A1 Jul. 20, 2006

(30) Foreign Application Priority Data

Dec. 15, 2004 (DE) ..... 20 2004 019 853 U

(51) Int. Cl.
*B25B 21/00* (2006.01)

(52) U.S. Cl. ..... 173/1; 173/2; 173/20; 173/217; 310/50; 318/433; 388/809

(58) Field of Classification Search ..... 173/217, 173/1, 2, 20, 181, 176; 310/47, 50; 318/433, 318/434; 388/809, 930
See application file for complete search history.

(56) References Cited

U.S. PATENT DOCUMENTS 3,352,368 A 11/1967 Maffey, Jr. ..... 173/169
4,609,089 A * 9/1986 Kobayashi et al. ..... 192/138
4,689,534 A * 8/1987 Gerber et al. ..... 388/809
4,790,218 A 12/1988 Cabrera ..... 81/57.13
5,016,501 A 5/1991 Holzer, Jr. ..... 81/57.11
5,105,130 A 4/1992 Barker et al. ..... 318/268
5,113,949 A * 5/1992 Ohkubo et al. ..... 173/177
5,289,885 A * 3/1994 Sakoh ..... 173/2
5,410,229 A * 4/1995 Sebastian et al. ..... 318/434
5,563,482 A * 10/1996 Shaw et al. ..... 318/272
6,536,536 B1 * 3/2003 Gass et al. ..... 173/2
6,968,908 B2 * 11/2005 Tokunaga et al. ..... 173/181
7,086,483 B2 * 8/2006 Arimura et al. ..... 173/217
7,089,080 B1 * 8/2006 Lysaght ..... 700/160
7,109,675 B2 * 9/2006 Matsunaga et al. ..... 318/433

OTHER PUBLICATIONS

European Search Report, Aug. 1, 2006, 4 pages.

* cited by examiner

*Primary Examiner*—Scott A. Smith
(74) *Attorney, Agent, or Firm*—St. Onge Steward Johnston & Reens LLC

(57) ABSTRACT

The invention discloses a power tool for screwing or drilling having a motor for driving a drive shaft, a controller for controlling the power tool, a motor switch for switching the motor on and off, switch for reversing the power tool between clockwise and counter-clockwise rotation, and vice versa, and a timer that permits reversal of the power tool between clockwise/counter-clockwise rotation, and vice versa, within a predefined period of time between actuation of the switch for clockwise/counter-clockwise rotation and for operation of the motor switch to start the power tool.

10 Claims, 2 Drawing Sheets

| SWSTART | DLL | TLL | DIR |
|---|---|---|---|
| 1 | 0 | 0 | 0 |
| 1 | 0 | 1 | 1 |
| 1 | 1 | 0 | 1 |
| 1 | 1 | 1 | 0 |

METHOD OF CONTROLLING THE DIRECTION OF ROTATION OF A POWER TOOL

CROSS-REFERENCE TO RELATED APPLICATIONS

The present application claims priority of German patent application No. 20 2004 019 853.3 filed on Dec. 15, 2004.

BACKGROUND OF THE INVENTION

The present invention relates to a power tool, in particular a power tool which is configured as screw runner or a drill, the power tool having a motor for driving a drive shaft, a controller for controlling the power tool, a motor switch for switching the motor on and off, and switching means for reversing the power tool between clockwise and counter-clockwise rotation.

The invention further relates to a method of controlling the direction of rotation of a power tool.

Drilling machines or screw runners of that kind have been in use for a long time.

Reversal between clockwise and counter-clockwise rotation is normally effected by actuation of a mechanical changeover switch.

In operation, screw runners normally are operated in permanent clockwise rotation or permanent counter-clockwise rotation. Screws are tightened in clockwise operation, and untightened in counter-clockwise operation.

Effecting the changeover mechanically presents, however, a disadvantage when the screw runner is to be operated in opposite direction, i.e. the direction opposite to the preset clockwise or counter-clockwise rotation, because in this case the changeover switch has to be actuated once more to effect clockwise or counter-clockwise rotation.

SUMMARY OF THE INVENTION

It is an object of the present invention to disclose an improved power tool, in particular a screw runner or a drilling machine, which guarantees easier operation, in particular an improved reversal between clockwise/counter-clockwise rotation.

It is a further object of the invention to disclose a method of controlling the direction of rotation of a power tool which avoids the drawbacks found in the prior art.

These and other objects are achieved according to the invention by a power tool having a motor for driving a drive shaft, a controller for controlling the power tool, a motor switch for switching the motor on and off, switching means for reversing the power tool between clockwise/counter-clockwise rotation, and vice versa, and a timer that permits reversal of the power tool between clockwise/counter-clockwise rotation, and vice versa, only within a predefined period of time between actuation of the switching means for clockwise/counter-clockwise rotation and operation of the motor switch to start the power tool.

A switching between clockwise operation and counter-clockwise operation can thus be easily achieved by activating the switching means within the given time frame, which may be done for instance by means of a touch-trigger.

According to a refinement of the invention a switching means is provided for reversing the power tool between permanent clockwise/permanent counter-clockwise rotation and vice versa, as well as a storage means for storing the permanent clockwise or permanent counter-clockwise operating state.

Thus it is possible to electronically reverse the power tool between permanent clockwise and permanent counter-clockwise rotation and to store the respective condition so that the power tool will always run in the same sense even if operated repeatedly.

On the other hand, it is also possible, once the power tool has been switched to permanent clockwise or permanent counter-clockwise rotation, to operate the power tool in the reverse sense of operation a single time within the predefined period of time, by actuation of a clockwise/counter-clockwise rotation changeover switch.

Such clockwise/counter-clockwise rotation control provides substantial advantages to the user. The user now is in a position to preset permanent clockwise or permanent counter-clockwise rotation at desire, and the preset condition will be maintained even after stoppage of the power tool. On the other hand, the user can switch over the power tool from that permanent clockwise or permanent counter-clockwise rotation to the opposite direction of rotation a single time by actuation of the clockwise/counter-clockwise rotation changeover switch. For example, it is now possible to operate the power tool permanently in clockwise rotation for tightening screws, for example, and to then operate it in counter-clockwise rotation for a single screwing operation within a predefined time window, by actuation of a changeover switch. When the motor is started the next time, the power tool will again operate in clockwise rotation, unless the clockwise/counter-clockwise rotation changeover switch is actuated again.

Conversely, the power tool may be set to permanent counter-clockwise rotation, for example for untightening screws, and can then be changed over to the reverse operating sense a single time within a predefined time window, by operation of the clockwise/counter-clockwise rotation changeover switch.

According to a further development of the invention, the controller is designed in such a way that the power tool will be reset to permanent clockwise rotation every time it is decoupled from voltage supply.

This feature provides the advantage that when started for the first time the power tool will always operate in clockwise rotation, which corresponds to the direction of rotation normally used. Changing over to short-time counter-clockwise rotation or permanent counter-clockwise rotation can be effected only by intentional reversal.

This is of advantage especially in cases where the power tool is used by different users or at different locations.

If the power tool is equipped with a battery, reversal to permanent clockwise rotation may be combined with the action of decoupling the power tool from the battery. According to another embodiment of the invention the switching means comprise first switching means for reversing a stored permanent clockwise rotation or permanent counter-clockwise rotation state to the respective opposite direction of rotation for a single start of the power tool.

This provides an especially advantageous way of using the power tool for different applications.

According to another embodiment of the invention, the period of time for reversing the power tool from clockwise to counter-clockwise rotation, and vice verse, and for operating the motor switch is maximally 30 seconds, preferably maximally 15 seconds, most preferably approximately 5 seconds.

This on the one hand gives the user sufficient time to allow the power tool to be reversed between clockwise and counter-clockwise operation, and vice versa. On the other hand, however, the time window for such reversal is not extended unnecessarily.

According to a further embodiment of the invention, the power tool comprises indicator means for indicating the state of counter-clockwise rotation.

It is possible in this way to signal to the user optically and/or acoustically that the power tool operates in clockwise or in counter-clockwise rotation.

According to a further embodiment of the invention, the switching means comprise a first switch and a second switch which, when operated, allow the power tool to be reversed between permanent clockwise and permanent counter-clockwise operation, and vice versa, in a predefined order.

To this end, the first switch, for example, may be designed as light switch that allows additional activation of a lighting system, while the second switch may be designed as clockwise/counter-clockwise rotation changeover switch.

It is possible in this way to easily procure intentional reversal between permanent clockwise and permanent counter-clockwise rotation, and vice versa.

At the same time, one of the two switches is given a dual function so that the lighting system can be operated without the necessity to provide an additional switch.

According to a further embodiment of the invention, the light switch is coupled with the motor switch in such a way that in a first switching stage only the light switch is operated while in a second switching stage the light switch and the motor switch are actuated simultaneously.

This provides the advantage that the light switch initially can be used separately to illuminate the working position before the motor switch is actuated, i.e. before the power tool starts running. This allows the power tool to be correctly positioned relative to the working point.

According to a further embodiment of the invention at least one of the switches is designed as momentary-contact switch. Preferably, even all of the switches are designed as momentary-contact switches.

Such a design permits an especially simple structure to be achieved because the actuation signals from the switches can be evaluated electronically so that no mechanical switching-over, which would have to be reversed later, is required.

According to a further development of the invention the motor switch is designed as pistol switch. According to a further development, the light switch and the motor switch can be operated by a common trigger.

One thereby obtains an especially simple and ergonomic structure in combination with the pistol-shaped design of the power tool.

It is of course understood that the power tool may also show any other type of construction. For example, the power tool may be designed as a narrow angle grinder. In this case, too, the light switch and the motor switch preferably can be actuated by a common trigger, which is, however, not designed as a pistol switch.

With respect to the method the object of the invention is solved by a method of controlling the direction of rotation of a power tool, comprising the following steps:

(A) setting the direction of rotation to clockwise or counter-clockwise;

(B) monitoring whether a switching means for reversing the direction of rotation is activated;

(C) starting a timer, if an activation of the switching means is sensed;

(D) monitoring, whether a motor switch is activated to start the motor, before a preset time period beginning with the starting of the timer has elapsed;

(E) if the motor switch is activated within the preset time period, reversing the direction of rotation of step (A) and starting the motor with the reversed direction of rotation; and (F) starting the motor with the direction of rotation preset in step (A), if the motor switch is activated after the preset time period has elapsed.

According to a further embodiment of the invention the permanent direction of rotation is saved.

According to a preferred development of this embodiment the permanent direction of rotation is reset to a predefined state, preferably to permanent clockwise direction of rotation, when the power tool is started the first time or when the power tool is cut off from power supply.

According to a further embodiment of the invention the permanent direction of rotation is reversed and saved when a certain switching means is activated.

According to a further embodiment of the invention the method further comprises the steps of:

operating the power tool with the saved permanent direction of rotation, if the motor switch is activated without activating the switching means for reversing the direction of rotation or when the motor switch is only activated after the preset time period of the timer has elapsed; and operating the power tool one time with a direction of rotation opposite to the saved permanent direction of rotation, if according to step (E), after having activated the switching means for reversing the direction of rotation, the motor switch is activated before the preset time period of the timer has elapsed.

According to a further embodiment of the invention the preset time period is 30 seconds at the most, preferably 15 seconds at the most, particularly preferred 5 seconds at the most.

According to a further embodiment of the invention a counter-clockwise operation of the power tool is indicated to a user using indicator means.

Thus it can be avoided that the power tool is operated unintentionally with the wrong direction of rotation.

It is understood that the features of the invention mentioned above and those yet to be explained below can be used not only in the respective combination indicated, but also in other combinations or in isolation, without leaving the scope of the invention.

BRIEF DESCRIPTION OF THE DRAWINGS

Further features and advantages of the invention will become apparent from the description that follows of a preferred embodiment of the invention, with reference to the drawing. In the drawings.

DETAILED DESCRIPTION OF THE PREFERRED EMBODIMENTS

Figure 1:
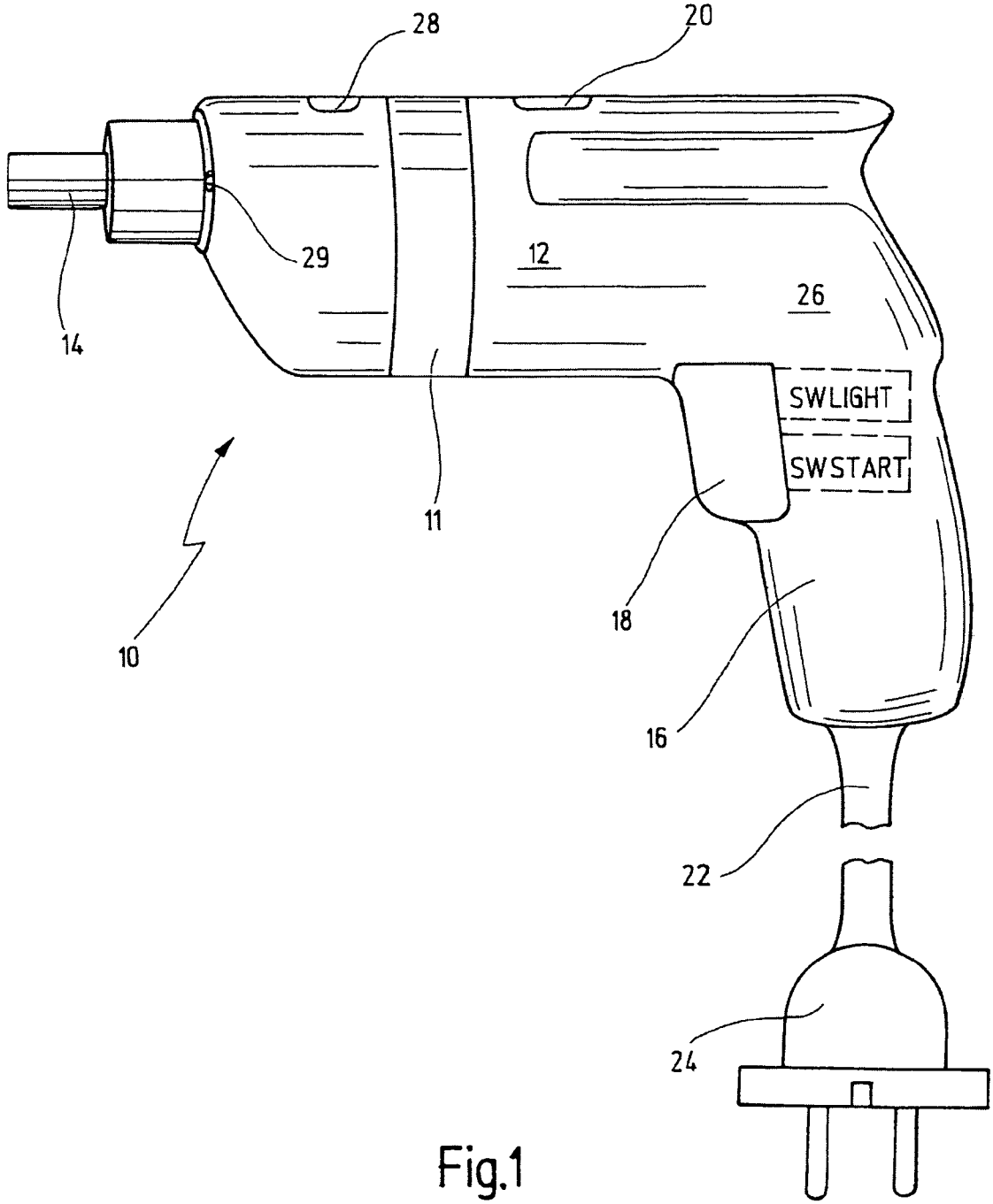
FIG. 1 shows a simplified view of a power tool according to the invention.

In FIG. 1, a power tool according to the invention being configured of a screw runner is shown and indicated generally by reference numeral 10.

The power tool 10 comprises a pistol-shaped housing 11 in which are received a motor, merely indicated by reference numeral 12, a gearing and a controller 26. The motor 12 drives, via a gearing not shown in detail, a drive shaft 14 intended to drive a tool, for example the bit of a screw runner. At the forward end of the housing 11, facing the drive shaft 14, there are provided a series of lighting elements 29, such as LEDs, that radiate in forward direction and allow the working position to be illuminated (in FIG. 1, a single LED can be seen only). At its lower end, the housing 11 comprises a pistol grip 16, with a line cord 22 provided on the latter's lower end for connection to a voltage source via a mains plug 24. A trigger 18 is provided in the area of the "pistol trigger" for actuation of the motor 12 and the lighting elements 29 of the power tool. In a first switching state, the trigger 18 acts on a momentary-contact light switch, indicated as SWLIGHT in FIG. 1. When the trigger 18 is pressed down further to a second switching state, it additionally acts on a motor switch, likewise in the form of a momentary-contact switch and indicated as SWSTART in FIG. 1. Further, a switch 20, designed as momentary-contact switch and serving to reverse the power tool between clockwise and counter-clockwise rotation, and vice versa, is arranged on the top of the housing 11.

Further, an indicator means 28 is provided in the forward upper area of the housing, for indicating that the power tool is running in counter-clockwise sense, which indicator may consist of one or more—for example flashing—LEDs.

It is understood that the arrangement of the switching elements and of the lighting elements, as shown in the embodiment illustrated in FIG. 1, is shown by way of example only and that other arrangements may be preferred depending on the particular design and housing of the respective power tool.

Likewise, it is understood that the power tool 10 may also be designed as battery-driven power tool in which case it can do without the line cord 22 and the mains plug 24, and a detachable battery pack may be provided at the lower end of the pistol grip 16, for example.

In the case of the power tool 10, the controller 26 is designed as microprocessor-based control that controls all the functions of the power tool, such as the soft start function of the motor, braking of the motor when the power tool is switched off, overload protection, speed control and/or power control, if desired, and further testing and checking functions.

The before-mentioned functions are, however, not part of the subject-matter of the present invention. The present invention relates to a novel way of setting the power tool to clockwise or counter-clockwise rotation. These different operating modes, and the way of setting them, will be described hereafter with reference to a flow chart shown in FIG. 2 and indicated generally by reference numeral 30. Further, consideration should be given in this connection to a function table or truth table illustrated in FIG. 3.

Basically, the power tool 10 can be run in clockwise or counter-clockwise rotation by reversing the polarity of the motor 12. Now, the control 26 is designed so that the mode known as permanent clockwise rotation will be assumed in the basic condition, i.e. when the power tool 10 is started for the first time. That permanent clockwise rotation can be reversed to permanent counter-clockwise operation by actuation of a predefined combination of momentary-contact switches. Further, the power tool can be operated a single time in the reverse direction of rotation, by operation of the clockwise/counter-clockwise rotation changeover switch 20, provided the motor switch is actuated within a predefined time window.

Figures 2, 3:
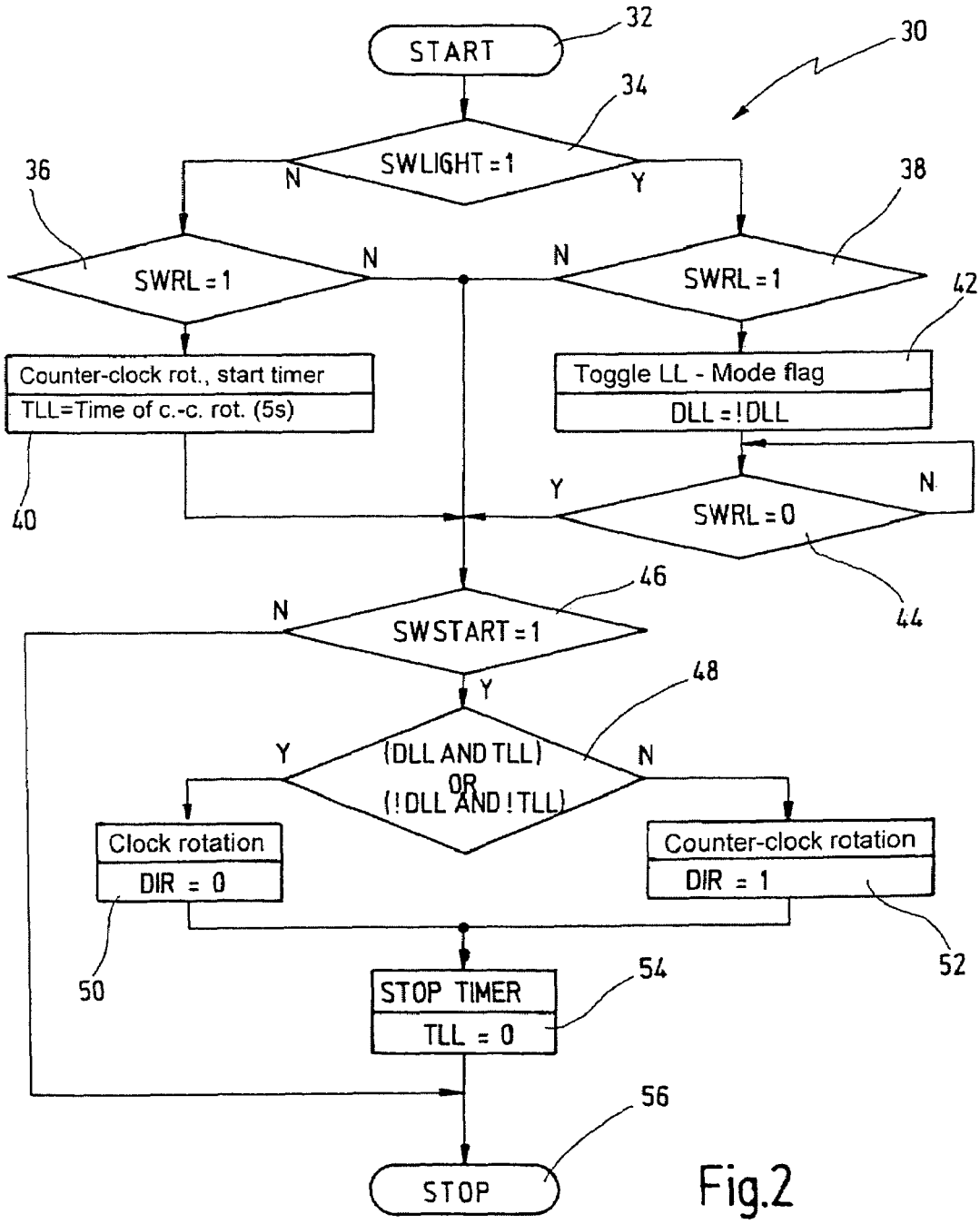
FIG. 2 shows a flow chart illustrating a switching logic of the controller allowing reversal of the power tool between clockwise and counter-clockwise rotation, and vice versa.
FIG. 3 shows a truth table illustrating the interrelations of the different switching states according to FIG. 2.

In FIG. 2, the setting state of the power tool to permanent clockwise rotation or permanent counter-clockwise rotation is defined by the value of variable DLL. When DLL=1, permanent counter-clockwise rotation is operative, i.e. the mode flag has been set. When DLL=0, permanent clockwise rotation is operative. The direction of rotation of the drive shaft is defined by variable DIR. In this connection, DIR=0 means that the drive shaft runs in clockwise sense, while DIR=1 means that it runs in counter-clockwise sense.

The control 26 further comprises a counter-clockwise rotation timer which is activated by pressing the momentary-contact switch 20. The timer value is defined by variable TLL. When TLL=0, the timer is switched off or the maximum time of the timer, for example 5 seconds, has elapsed. When TLL=1, the timer has not elapsed yet.

The design illustrated in FIG. 2 makes additional use of a light switch indicated by SWLIGHT. SWLIGHT is actuated in a first switching stage by pressing down the trigger 18. When the trigger 18 is pressed down further, the motor switch, indicated in FIG. 1 by SWSTART, is actuated in addition to SWLIGHT.

In FIG. 2, the decision flow is represented by lozenges as usual, the outputs being indicated by Y and N, standing for "yes" or "no".

FIG. 2 further makes use of the usual rectangular function blocks, and of a starting point and an end defining the logic beginning of the decision logic and/or the logic end of the decision logic.

The combinations achievable with the decision logic according to FIG. 2 are summarized in the truth table (function table) according to FIG. 3.

The first line in that table means that when the motor switch SWSTART has been actuated, no permanent counter-clockwise rotation has been set and the timer has not been actuated or has elapsed, the power tool operates in clockwise rotation: DIR=0.

From the second line it can be derived that when the motor switch SWSTART has been actuated, no permanent counter-clockwise rotation has been set and the clockwise/counter-clockwise rotation changeover switch SWRL has been actuated (SWRL=1) and the timer has not elapsed yet (TLL=1), the power tool operates in counter-clockwise rotation: DIR=1.

The third line of FIG. 3 shows that when the motor switch SWSTART has been actuated, permanent counter-clockwise rotation is set and the timer has not been operated or has elapsed, the power tool likewise operates in counter-clockwise rotation: DIR=1.

In contrast, it can be derived from the last line that when the motor switch is actuated, permanent counter-clockwise rotation is set and the timer has been activated or has not elapsed yet, the power tool operates in clockwise rotation: DIR=0.

Starting out from the basic condition DLL=0 (permanent clockwise rotation) or DLL=1 (permanent counter-clockwise rotation), the power tool can therefore be transferred to the respective preset permanent operating mode by pressing down the motor switch. Or, alternatively, the clockwise/counter-clockwise rotation changeover switch SWRL can be activated before the motor switch SWSTART is actuated. When the motor switch is then actuated within the predefined timer period of 5 seconds, the preset permanent direction of rotation will be changed over to the reverse direction of rotation for a single time.

That behavior will now be described in more detail with reference to FIG. 2. Once the decision logic has been activated at the start indicated by 32, it is initially inquired, at branch 34, if the light switch SWLIGHT has been activated by operation of the trigger 18. If this is the case, the right-hand output from branch 34 applies. It is then inquired at branch 38 if the clockwise/counter-clockwise rotation changeover switch SWRL has been actuated in addition to the light switch. If this is the case, a predefined permanent counter-clockwise or permanent clockwise direction of rotation is reversed to the reverse direction of rotation, which is stored. This is taken into consideration, and stored, by the microprocessor using a "mode flag". The resulting indication at box 42 is DLL=!DLL, the "!" representing a negation, i.e. a logic NOT. After reversal of the permanent direction of rotation in box 42 it is inquired at branch 44 if the clockwise/counter-clockwise rotation changeover switch SWRL has been released again. If this is the case, it is determined by the next inquiry 46 if the motor switch has been actuated. When SWRL has not been released again, the system waits until this has happened, as indicated by the feedback loop.

When it is determined at branch 34 that the light switch has not been activated, it is first determined at branch 36 if the clockwise/counter-clockwise rotation changeover switch SWRL has been additionally actuated. When it has not, the right-hand output directly leads to the next branch 46, i.e. the inquiry if the motor switch has been actuated. However, when the clockwise/counter-clockwise rotation changeover switch SWRL has been actuated, the timer is started at block 40, and the output leads to the next branch 46.

At branch 46 it is now determined if the motor switch SWSTART has been actuated. If SWSTART has not been actuated, the left-hand output of the branch directly leads to the end 56 (STOP). However, when the motor switch is actuated, the output of branch 46 leads to the next branch 48. Now, when permanent counter-clockwise operation has been set, the timer has been actuated and has not elapsed yet (DLL AND TLL), the left-hand output results, i.e. the preset permanent counter-clockwise rotation is reversed to clockwise rotation, which is indicated as clockwise rotation in block 50 (DIR=0). The timer is then reset at block 54 (TLL=0), and the process ends at 56.

In contrast, when it is determined at branch 48 that the logic combination of permanent counter-clockwise rotation DLL and activated and still active timer TLL is not true, then the right-hand output results so that the power tool is operated in counter-clockwise rotation, as indicated at box 52 by DIR=1. The timer is then stopped at box 54, and the process ends at 56.

As an alternative to that inquiry (DLL AND TLL), the logic expression (!DLL AND !TLL) is further inquired via a logic OR operation. The inquiry, therefore, is whether permanent counter-clockwise rotation has been set and the timer has not been actuated or has elapsed. If this is true, the power tool is operated in clockwise rotation and the left-hand output to box 50 applies. If this is not true because, for example, permanent counter-clockwise rotation has been set and the timer has not been actuated or because permanent clockwise rotation has been set and the timer has been actuated and has not elapsed yet, the right-hand output to box 52 applies; the power tool is operated in counter-clockwise rotation.

Preferably the controller 26 is configured programmable, e.g. it may be configured as a microprocessor based controller. The decision logic tree according to FIG. 2 will be run periodically every 1 to 10 milliseconds.

What is claimed is:

1. A method of controlling the direction of rotation of a drive shaft of a power tool, comprising the following steps:

(A) setting the direction of rotation to clockwise or counter-clockwise;

(B) monitoring whether a switching means for reversing the direction of rotation is activated;

(C) starting a timer, if an activation of the switching means is sensed;

(D) monitoring, whether a motor switch is activated to start the motor, before a preset time period beginning with the starting of the timer has elapsed;

(E) if the motor switch is activated within the preset time period, reversing the direction of rotation of step (A) and starting the motor with the reversed direction of rotation; and (F) starting the motor with the direction of rotation preset in step (A), if the motor switch is activated after the preset time period has elapsed.

2. The method of claim 1, wherein a permanent direction of rotation is saved.

3. The method of claim 2, wherein said permanent direction of rotation is reset to a clockwise direction of rotation when the power tool is started the power tool is cut off from power supply.

4. The method of claim 2, wherein said permanent direction of rotation is reversed and saved when a certain switching means is activated.

5. The method of claim 4, further comprising the steps of (G) operating the power tool with the saved permanent direction of rotation, if the motor switch is activated without activating the switching means for reversing the direction of rotation or if the motor switch is activated after the preset time period of the timer has elapsed; and (H) operating the power tool one time with a direction of rotation opposite to the saved permanent direction of rotation, if according to step (E), after having activated the switching means for reversing the direction of rotation, the motor switch is activated before the preset time period of the timer has elapsed.

6. The method of claim 1, wherein the preset time period is 30 seconds at the most.

7. The method of claim 5, wherein the preset time period is 15 seconds at the most.

8. The method of claim 5, wherein the preset time period is 5 seconds at the most.

9. The method of claim 1, wherein a counter-clockwise operation of the machine is indicated to a user using an indicator means.

10. The method of claim 9, wherein a counter-clockwise operation of the power tool is indicated to a user by means of a flashing light.

* * * * *